US008736506B1

(12) United States Patent
Brock et al.

(10) Patent No.: US 8,736,506 B1
(45) Date of Patent: May 27, 2014

(54) WIDEBAND AIRCRAFT ANTENNA WITH EXTENDED FREQUENCY RANGE

(75) Inventors: David W. Brock, San Diego, CA (US); Hale B. Simonds, Santee, CA (US); Patrick A. Groves, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 249 days.

(21) Appl. No.: 13/080,389

(22) Filed: Apr. 5, 2011

(51) Int. Cl.
*H01Q 9/28* (2006.01)

(52) U.S. Cl.
USPC ..... 343/795; 343/786

(58) Field of Classification Search
USPC ..... 343/795, 786, 767, 770
See application file for complete search history.

(56) References Cited

U.S. PATENT DOCUMENTS

| | | | | |
|---|---|---|---|---|
| 5,519,408 | A * | 5/1996 | Schnetzer | 343/767 |
| 6,876,334 | B2 | 4/2005 | Song et al. | |
| 7,027,002 | B2 * | 4/2006 | Suh et al. | 343/773 |
| 7,193,575 | B2 * | 3/2007 | Mohammadian | 343/767 |
| 7,479,929 | B2 * | 1/2009 | Pintos et al. | 343/772 |
| 2005/0012672 | A1 * | 1/2005 | Fisher | 343/767 |
| 2011/0057852 | A1 * | 3/2011 | Holland et al. | 343/795 |

* cited by examiner

*Primary Examiner* — Ahshik Kim
(74) *Attorney, Agent, or Firm* — Kyle Eppele

(57) ABSTRACT

A compact, broadband, aerodynamically streamlined, mechanically rugged antenna for aircraft and other applications has been developed that has a VSWR of 2:1 or better, and has uniform patterns with no nulls over a wide 8:1 bandwidth from 225 MHz to 1.85 GHz. The antenna has an aerodynamically streamlined shape, with a rugged housing capable of withstanding velocities up to Mach 2. In addition to its usage on aircraft, this antenna would be useful in a wide range of applications as a general purpose, wide bandwidth omnidirectional antenna. The antenna achieves its performance capabilities with the use of a double Vivaldi element feed section, an upper extension made of resistive film or R-card, and a shaped boundary between the feed and upper sections of the radiating elements.

18 Claims, 22 Drawing Sheets

| | |
|---|---|
| Frequency | =1088 |
| Main lobe magnitude | =6.9 dB |
| Main lobe direction | =35.0 deg. |
| Angular width (3 dB) | =33.2 deg. |

| | |
|---|---|
| Frequency | =1600 |
| Main lobe magnitude | =7.4 dB |
| Main lobe direction | =129.0 deg. |
| Angular width (3 dB) | =27.6 deg. |
| Side lobe level | =-2.9 dB |

Type H-Field (peak)
Monitor h-field (f=1088) [1]
Component x
Maximum-3d 11.5017 A/m at 0 / 0 / 0
Frequency 1088
Amplitude Plot

| | |
|---|---|
| 1 | 0.0230 A/m |
| 2 | 0.0280 A/m |
| 3 | 0.0330 A/m |
| 4 | 0.0400 A/m |
| 5 | 0.0650 A/m |
| 6 | 0.1000 A/m |
| 7 | 0.1500 A/m |
| 8 | 0.2000 A/m |
| 9 | 0.3000 A/m |
| 10 | 0.4000 A/m |

| | |
|---|---|
| Type | H-Field (peak) |
| Monitor | h-field (f=1600) [1] |
| Component | x |
| Maximum-3d | 11.5186 A/m at 0 / 0 / 0 |
| Frequency | 1600 |
| Amplitude Plot | |

| | |
|---|---|
| Frequency | =1088 |
| Main lobe magnitude | =2.1 dB |
| Main lobe direction | =46.0 deg. |
| Angular width (3 dB) | =68.6 deg. |

| | |
|---|---|
| Frequency | =1600 |
| Main lobe magnitude | =4.1 dB |
| Main lobe direction | =0.0 deg. |
| Angular width (3 dB) | =29.4 deg. |
| Side lobe level | =−2.7 dB |

WIDEBAND AIRCRAFT ANTENNA WITH EXTENDED FREQUENCY RANGE

FEDERALLY-SPONSORED RESEARCH AND DEVELOPMENT

This invention is assigned to the United States Government. Licensing inquiries may be directed to Office of Research and Technical Applications, Space and Naval Warfare Systems Center, Pacific, Code 72120, San Diego, Calif., 92152; telephone 619-553-2778; email: T2@spawar.navy.mil. Reference Navy Case No. 100,544.

BACKGROUND

This disclosure relates generally to the field of antennas. More particularly, this disclosure relates to wideband, omnidirectional, flat blade-shaped, monopole antennas.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a broadband, low voltage-standing-wave-ratio (VSWR), omnidirectional, blade antenna is provided, comprising: a double Vivaldi element with a bottom portion having edges with Vivaldi curves, and a top portion having a concave-shaped edge; a non-metallic, co-planar upper element resistive sheet coupled to the concave-shaped edge; and a feed coupled to a center of the bottom portion of the Vivaldi element.

In another aspect of the disclosed embodiments, a method for efficiently radiating/receiving electromagnetic radiation in an omnidirectional pattern, with a low VSWR is provided, comprising: forming a double Vivaldi element with a bottom portion having edges with a Vivaldi curves, and a top portion having a concave-shaped edge; joining a non-metallic, co-planar upper element resistive sheet to the concave-shaped edge; coupling a feed to a feed-side of the Vivaldi element; and at least one of exciting the feed with a radio signal or receiving a radio signal from the feed.

In yet another aspect of the disclosed embodiments, a broadband blade antenna is provided, comprising: first means for at least one of radiating or receiving electromagnetic signals in an omnidirectional, null-free, broadside pattern, having a lower double Vivaldi curvature and an upper concave-shaped edge; means for passively resisting current, having a coplanar structure and attached to the upper concave-shaped edge; second means for at least one of radiating or receiving electromagnetic signals in an omnidirectional, null-free, broadside pattern, having an upper double Vivaldi curvature; means for exciting or receiving excitation signals from the first and second double Vivaldi means; and means for supporting the second double Vivaldi means.

DETAILED DESCRIPTION

For certain platforms, wide bandwidth antennas with patterns that are as close as possible to being omnidirectional are needed for mission objectives. One specific platform is an aircraft where the antenna is designed to be mounted to the exterior of the aircraft. Of particular interest in the aircraft community are antennas that have a frequency range of 225 MHz to 1.85 GHz, with a minimum gain at the horizon of 0 dBi, and a maximum in-band VSWR of 2:1. Since the antenna is mounted to the exterior of the aircraft, it must have a narrow profile, such as a monopole, to withstand high wind speeds.

A well known way to make a monopole antenna attain a larger bandwidth is to give it a large diameter as shown in U.S. Pat. No. 6,667,721 to Simonds. Monopole and dipole antennas based on this bicone design have attained bandwidths in excess of 10:1, with low VSWR values, and with wide antenna patterns having no nulls over the operating frequency range. A problem, though, with mounting an antenna of this design on the skin of an aircraft is that it does not present the required narrow profile to the incident air.

However, flat blade shaped monopole antenna elements, with the blade structure oriented parallel to the air flow, are able to meet the criteria of a large electrical "diameter," with the ability to present a narrow profile to the air. Unfortunately, a flat blade shaped antenna is not known to possess omnidirectional antenna patterns over the frequency range described above.

In view of these issues, several new designs have been investigated herein using a flat blade antenna of the form called a Vivaldi antenna, by modeling these designs using modeling software called MICROWAVE STUDIO® by Computer Simulation Technology (CST) AG of Darmstadt, Germany. The results of these investigations are described below.

Figure 1:
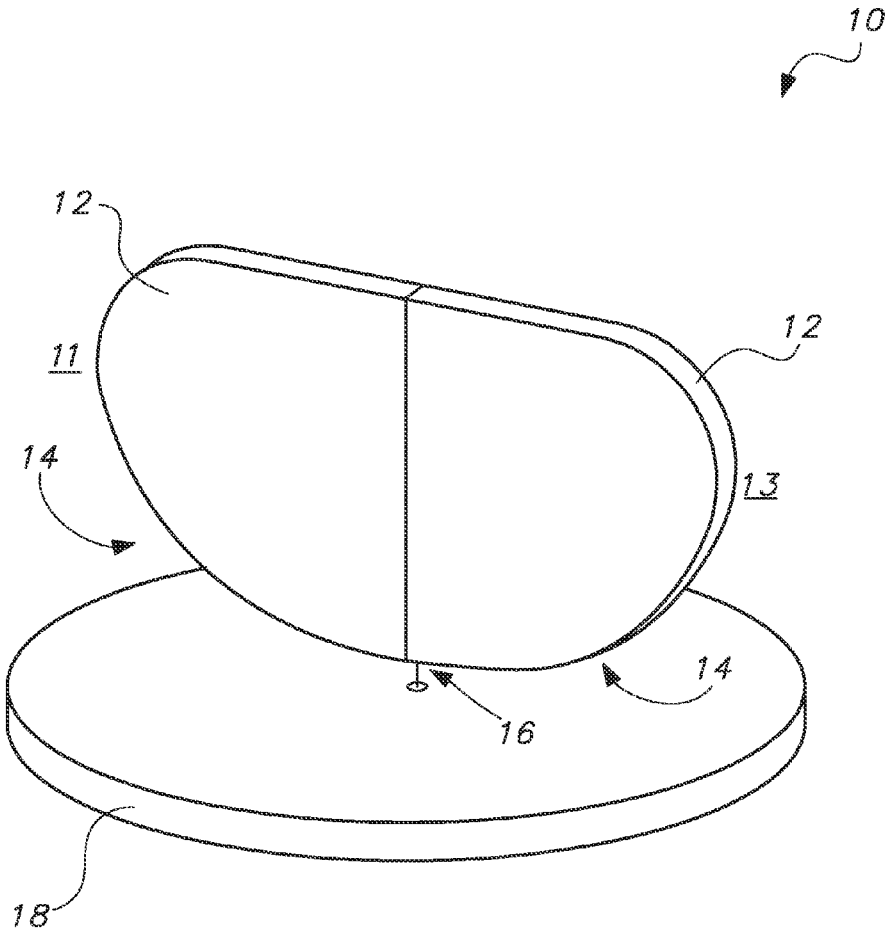
FIG. 1 is an illustration of a double Vivaldi antenna element, over a ground plane.

As shown in FIG. 1, a Vivaldi antenna 10 is a flat blade-shaped monopole structure comprising two opposing Vivaldi sections 12 arranged to face the front 11 and back 13 of the blade structure. The curvatures 14 are Vivaldi's curvature and are replicated on both "edges" of the Vivaldi sections 12. A ground plane, shown truncated, 18 is disposed below the feed point 16 to provide mirror currents. In operation, radio frequency currents are fed through a coaxial transmission line (not shown) that leads up through the ground plane 18 to excite the Vivaldi sections 12 at feed point 16. It can be shown that at RF energy flows outward from the feed point 16 toward the front 11 and back 13 of the antenna 10, with mirror currents being replicated on the ground plane 18. Having a height of approximately 2.548 inches from the feed point 16 to the top of the antenna 10, and a width of approximately 4.50 inches, the double Vivaldi antenna 10 of FIG. 1 covers a frequency range of 900 MHz to 1.850 GHz with a VSWR of less than 2:1. One way to extend the bottom of the frequency range down to 225 MHz is to increase the dimensions of the antenna 10. However, rather than increasing the entire antenna 10, one investigated approach is to extend only the top portion of the antenna 10.

Figure 2:
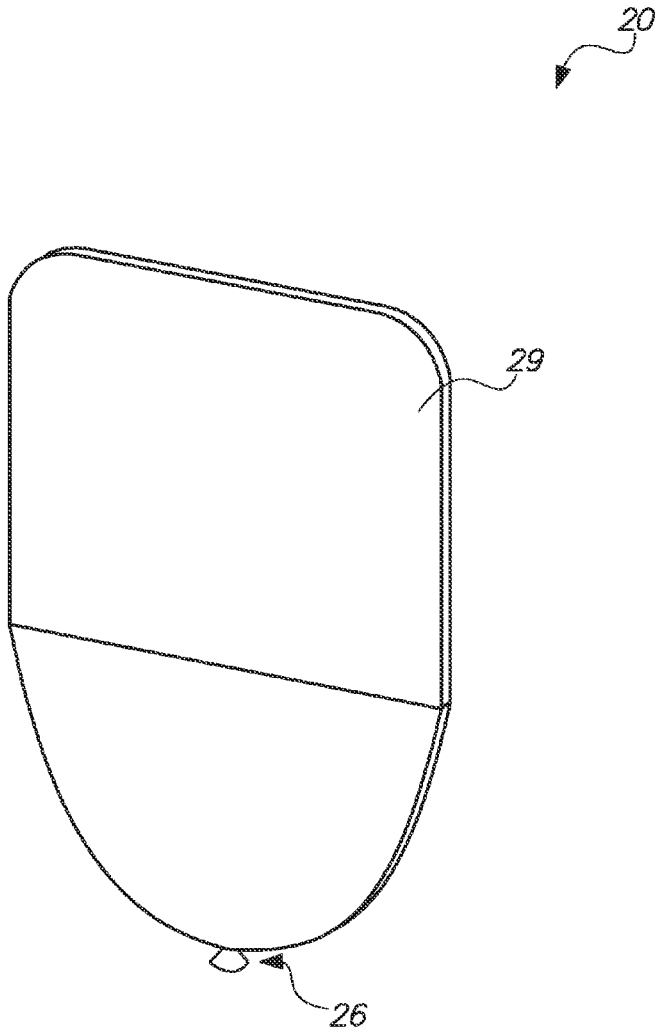
FIG. 2 is an illustration of another double Vivaldi antenna element with a metal extension on the upper section.

FIG. 2 is an illustration of an exemplary double Vivaldi antenna 20 with an upper metal extension 29. The metal extension 29 is approximately 7.196 inches in height, giving an overall height of approximately 9.744 inches and an overall width of approximately 6.688 inches. It is noted that for illustration purposes, the ground plane is not shown, being understood as implicit in all of these drawings. Accordingly, feed point 26 is illustrated as a truncated cone.

Figure 3:
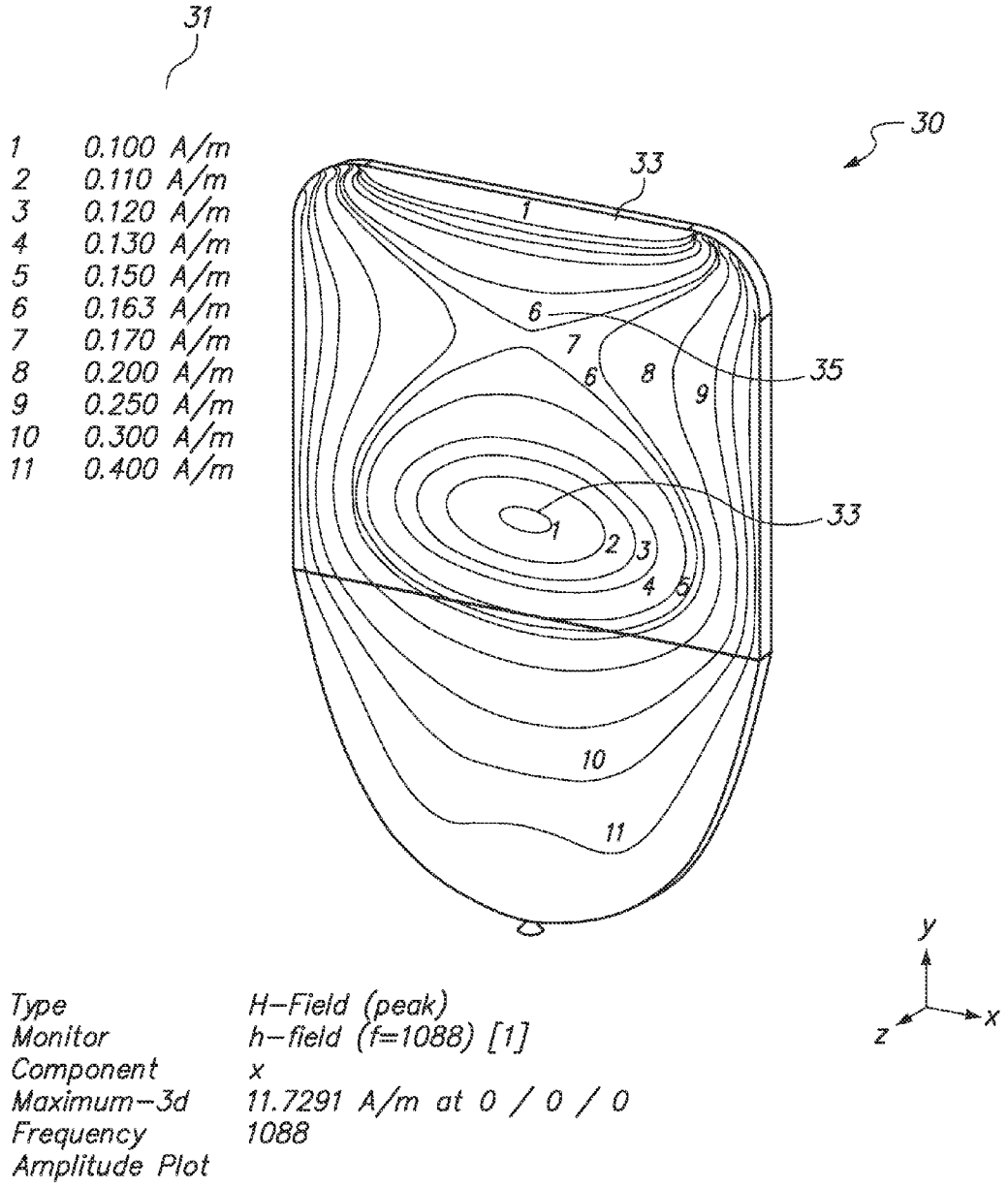
FIG. 3 is a plot of the simulated current amplitude distribution of the Vivaldi antenna of FIG. 2, at 1.088 GHz.

FIG. 3 is a MICROWAVE STUDIO® simulation of the Vivaldi antenna 20 of FIG. 2 at 1.088 GHz showing the current amplitude distribution 30 on the face of the antenna. The current amplitudes are indicated by reference to the legend 31, with lower numbers (e.g., 1) indicating lower amplitudes; and higher numbers (e.g., 11) indicating higher amplitudes. A standing wave pattern is recognizable by noticing low current points 33 in the middle and top of the antenna with a higher current point 35 therebetween.

Figure 4:
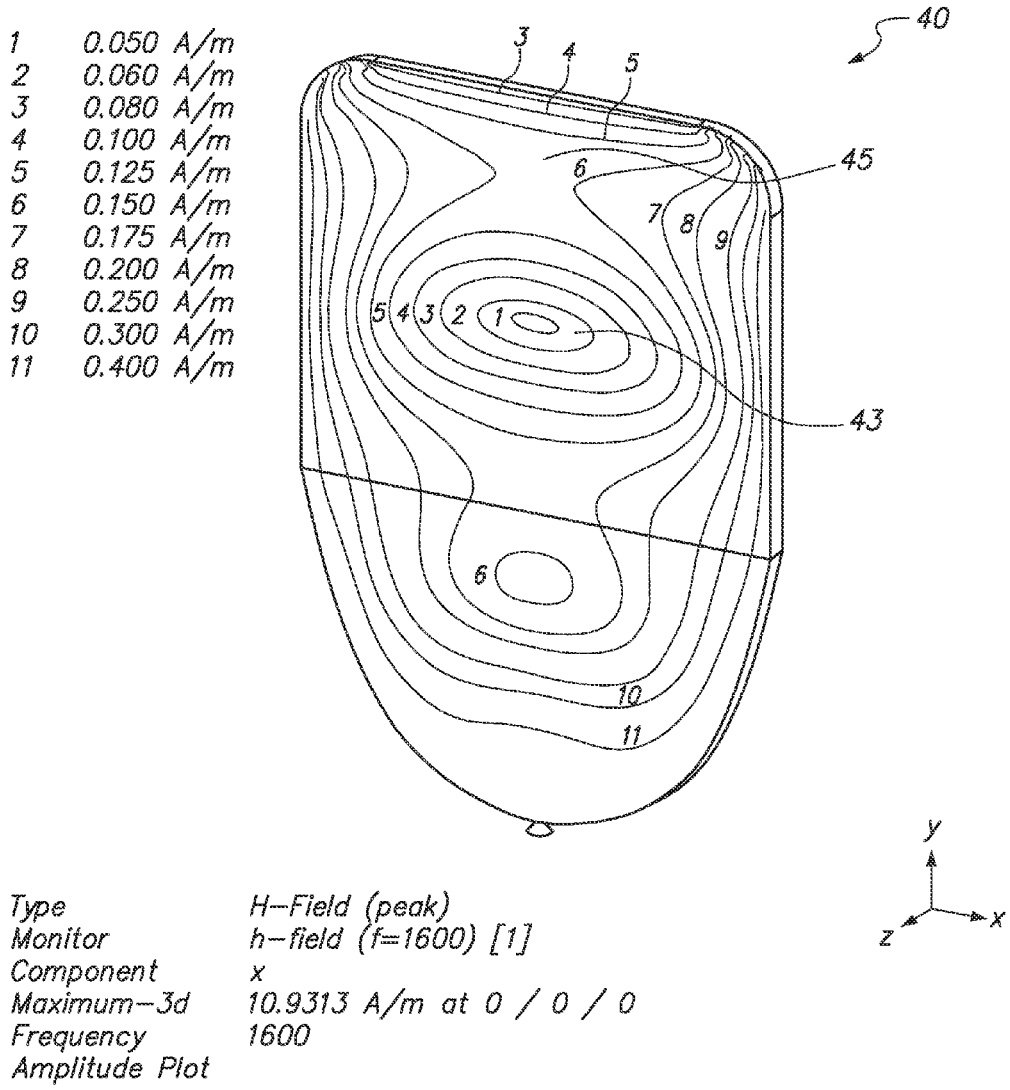
FIG. 4 is a plot of the simulated current amplitude distribution of the Vivaldi antenna of FIG. 2, at 1.600 GHz.

FIG. 4 is a MICROWAVE STUDIO® simulation of the Vivaldi antenna 20 of FIG. 2 at 1.600 GHz showing the current amplitude distribution 40 on the face of the antenna. The current distribution still contains a low current point 43 with a higher current point 45 between it and the top of the antenna (i.e., standing wave). This exemplary approach increases the gain at 225 MHz to over 0 dBi, and reduces the VSWR to less than 2:1, however, as seen the following directivity plots, this causes splits to develop in the patterns at higher frequencies.

Figure 5:
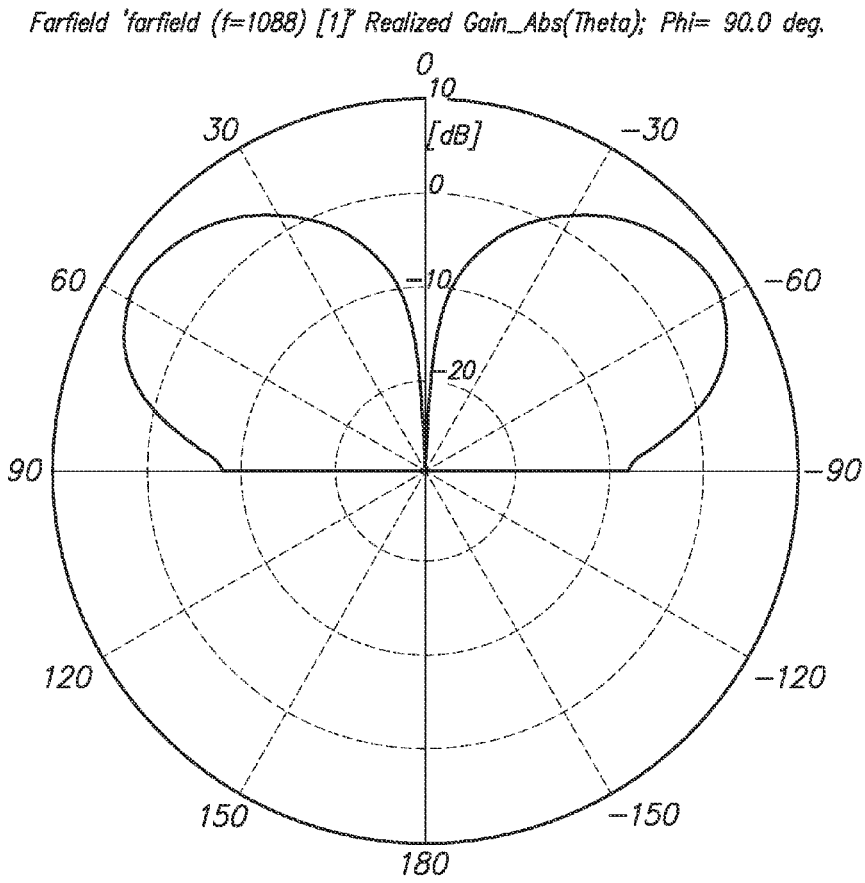
FIG. 5 is a plot of the simulated antenna elevation pattern of the Vivaldi antenna of FIG. 2, at 1.088 GHz.
Figure 6:
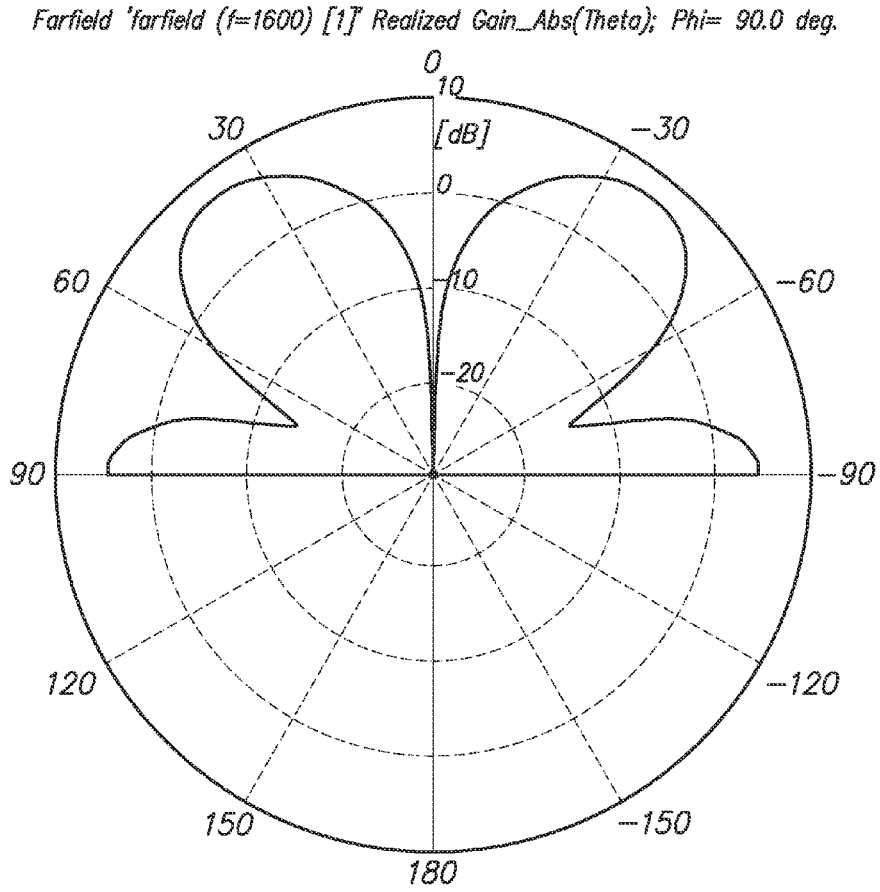
FIG. 6 is a plot of the simulated antenna elevation pattern of the Vivaldi antenna of FIG. 2, at 1.600 GHz.

FIG. 5 is a simulated antenna elevation pattern plot of the Vivaldi antenna 20 of FIG. 2, at 1.088 GHz. FIG. 6 is a simulated antenna elevation pattern plot of the Vivaldi antenna 20 of FIG. 2, at 1.600 GHz. Very evident in both FIGS. 5 and 6 is the splitting of the patterns. In FIG. 5 the split is located at the horizon, while in FIG. 6 it has moved to 20 degrees above the horizon. The split is due to the formation of standing wave patterns on the antenna, as shown in FIGS. 3-4, being most noticeable at the higher frequencies. In general, when the height of a monopole antenna is greater than or equal to a quarter wavelength, nulls or splits will occur in the patterns at certain elevation angles.

Figure 7:
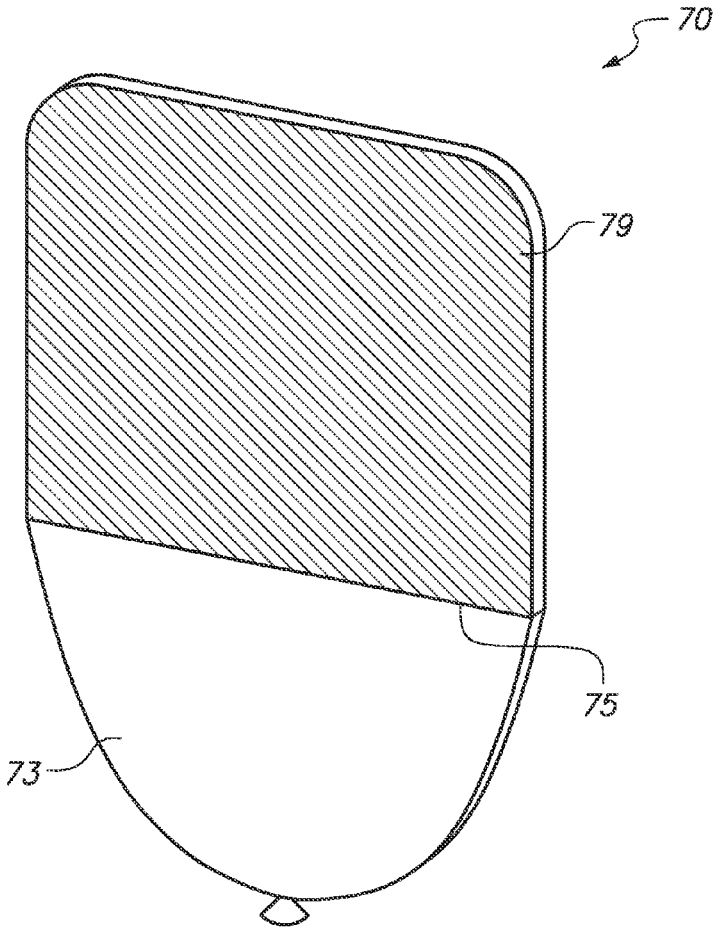
FIG. 7 is an illustration of another double Vivaldi antenna element with a resistive film extension on the upper section.

FIG. 7 is an illustration of an exemplary double Vivaldi antenna 70 with a resistive film extension 79 joined at a metal-to-resistive boundary 75 to the lower metal section 73. The embodiment of FIG. 7 is similar to the antenna 20 of FIG. 2, with the exception of the extension being formed of a resistive film rather than metal. The height of the metal section was approximately 4.244 inches and the height of the resistive film extension was approximately 5.5 inches, giving an overall height of approximately 9.744 inches. The overall width was 6.688 inches. The height and width of the metal section were adjusted from those of the original values of FIG. 1 to optimize the gain patterns. The resistive film extension 79 can be a resistive sheet (R-card), such as a dielectric sheet with a carbon-based resistive coating, one such example coming from R & F Products of San Marcos, Calif., or similarly acting material. Computer analysis demonstrated that, for this particular embodiment, the optimum resistivity of the resistive film for the resistive film extension 79 was 150 ohms per square.

Figure 8:
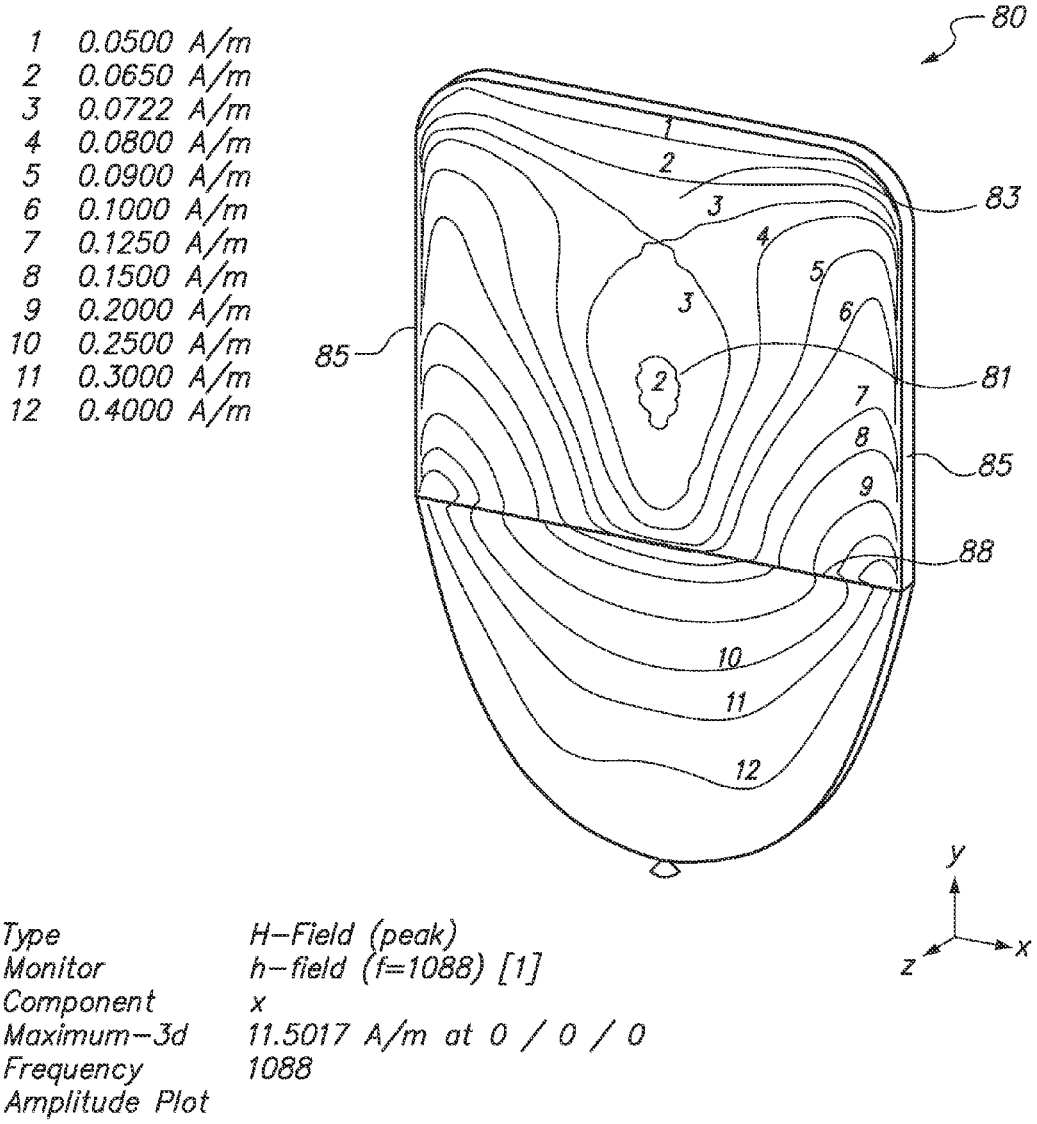
FIG. 8 is a plot of the simulated current amplitude distribution of the Vivaldi antenna of FIG. 7, at 1.088 GHz.

FIG. 8 is a MICROWAVE STUDIO® simulation showing a plot of the current amplitude distribution 80 of the Vivaldi antenna 70 of FIG. 7, at 1.088 GHz. Evident in this plot 80 is the fact that while there appears to be a small standing wave pattern at the center of the antenna, the effect is negligible due to the near equivalency of amplitudes between the low (81) and higher current (83) points. Also, it is noticed that unlike the earlier embodiments, the highest current value (e.g., 0.4000 A/m) does not rise all the way up the sides 85 of the antenna to the top of the antenna. These results are presumed to be due to two mechanisms. The first mechanism is that the standing waves are broken up by having two reflection points, at the top of the antenna, and at the metal-resistive film boundary 88. The second mechanism is through the absorption of a small portion of the RF energy in the resistive film, so that there is less energy to be reflected back down the antenna. A consequence of the absorption of the RF energy in the resistive film is that the gain of the antenna is reduced, but only by a small amount.

It should be noted that in designing the resistance value of the resistive film extension 79 of FIG. 7, it was set so that the magnitudes of the reflections of the RF energy at the boundary between the metal and resistive film extension 79 and the upper edge of the resistive film extension 79 were approximately equal to each other. Theoretically speaking, the resistive film extension 79 operates to improve the performance and reduce the VSWR at low frequencies by acting as conductive extensions, increasing the length of the antenna. The standing wave patterns on the exemplary antenna 70 are minimized through the near equivalency of the reflections at the metal-to-resistive film boundary 75 and the top end of the resistive film extension 79, and to a lesser extent through absorption of RF energy in the resistive film extension 79, itself.

Figure 9:
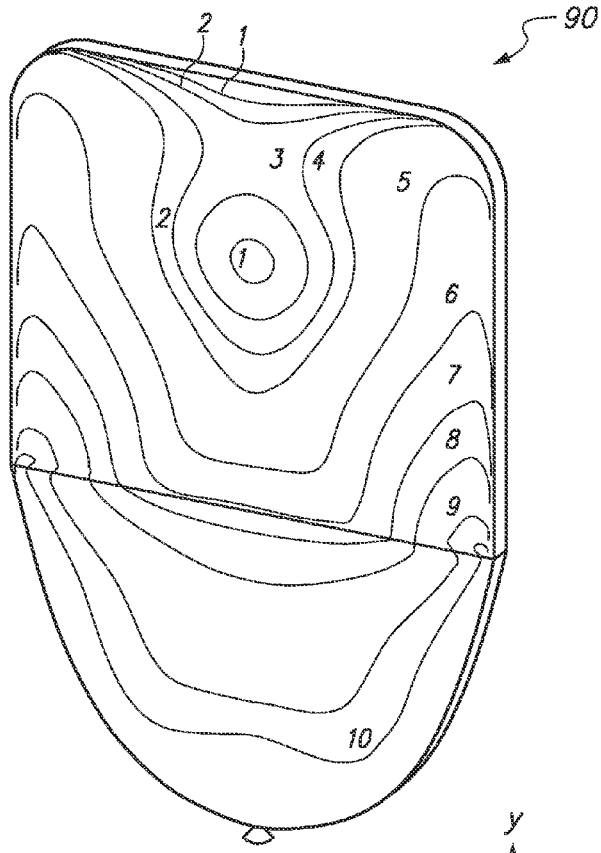
FIG. 9 is a plot of the simulated current amplitude distribution of the Vivaldi antenna of FIG. 7, at 1.600 GHz.

FIG. 9 is a MICROWAVE STUDIO® simulation showing a plot of the current amplitude distribution 90 of the Vivaldi antenna 70 of FIG. 7, at 1.600 GHz. The results are similar to the results shown in FIG. 8, but slightly shifted to the top of the antenna.

Figure 10:
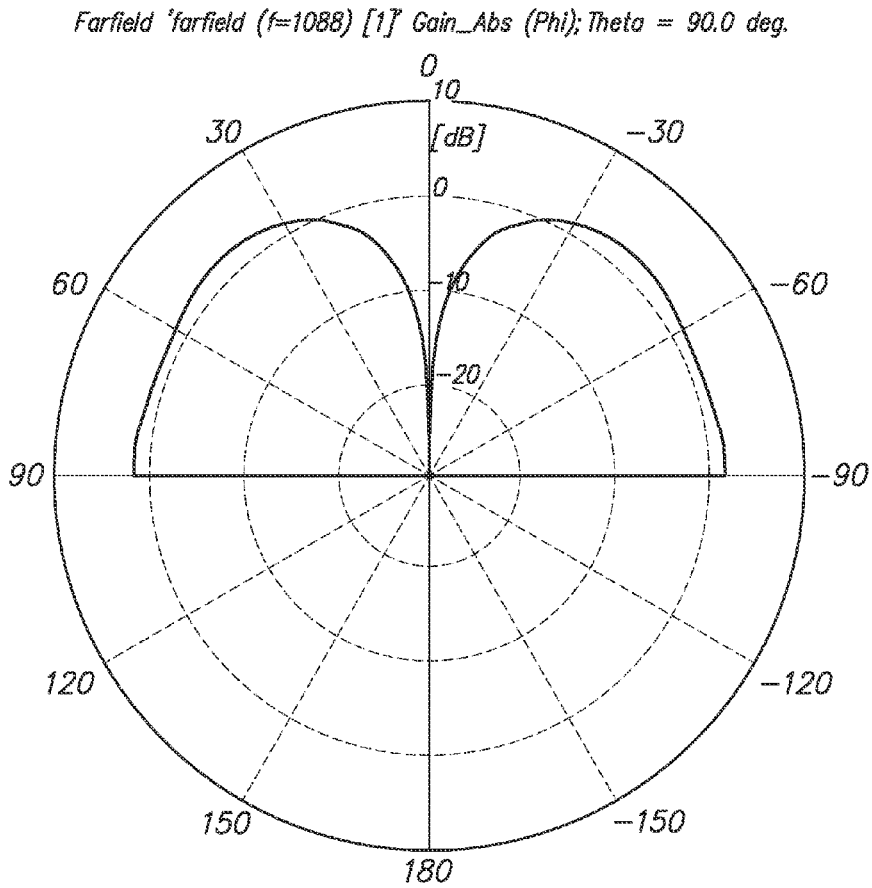
FIG. 10 is a plot of the simulated antenna elevation pattern of the Vivaldi antenna of FIG. 7, at 1.088 GHz.
Figure 11:
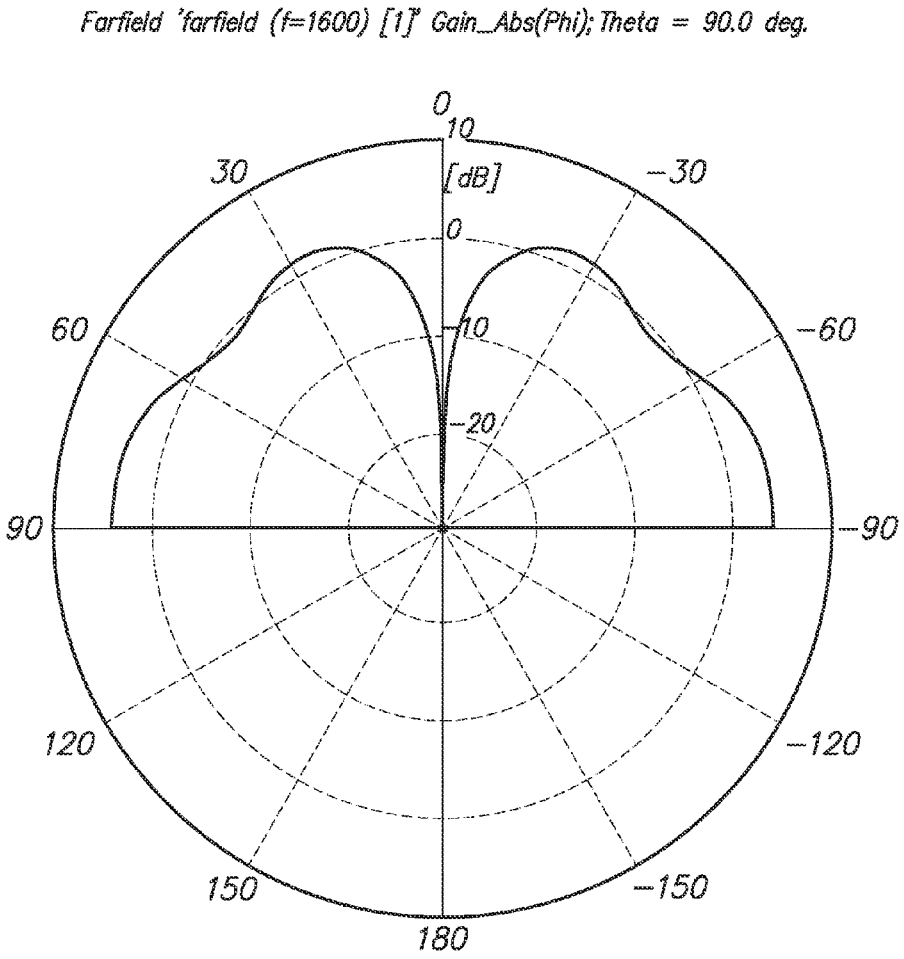
FIG. 11 is a plot of the simulated antenna elevation pattern of the Vivaldi antenna of FIG. 7, at 1.600 GHz.

FIGS. 10-11 are plots of the simulated antenna elevation pattern of the Vivaldi antenna 70 of FIG. 7, at 1.088 GHz and 1.600 GHz, respectively. Evident in these plots is the fact that the pattern does not split, as seen in FIGS. 5-6. Accordingly, these plots demonstrate that the exemplary antenna 70 of FIG. 7 overcomes most of the pattern splitting issue found in the antenna 20 of FIG. 2. Thus, a modified double Vivaldi antenna having a resistive film extension can provide pattern integrity over the bands of interest.

Figure 12:
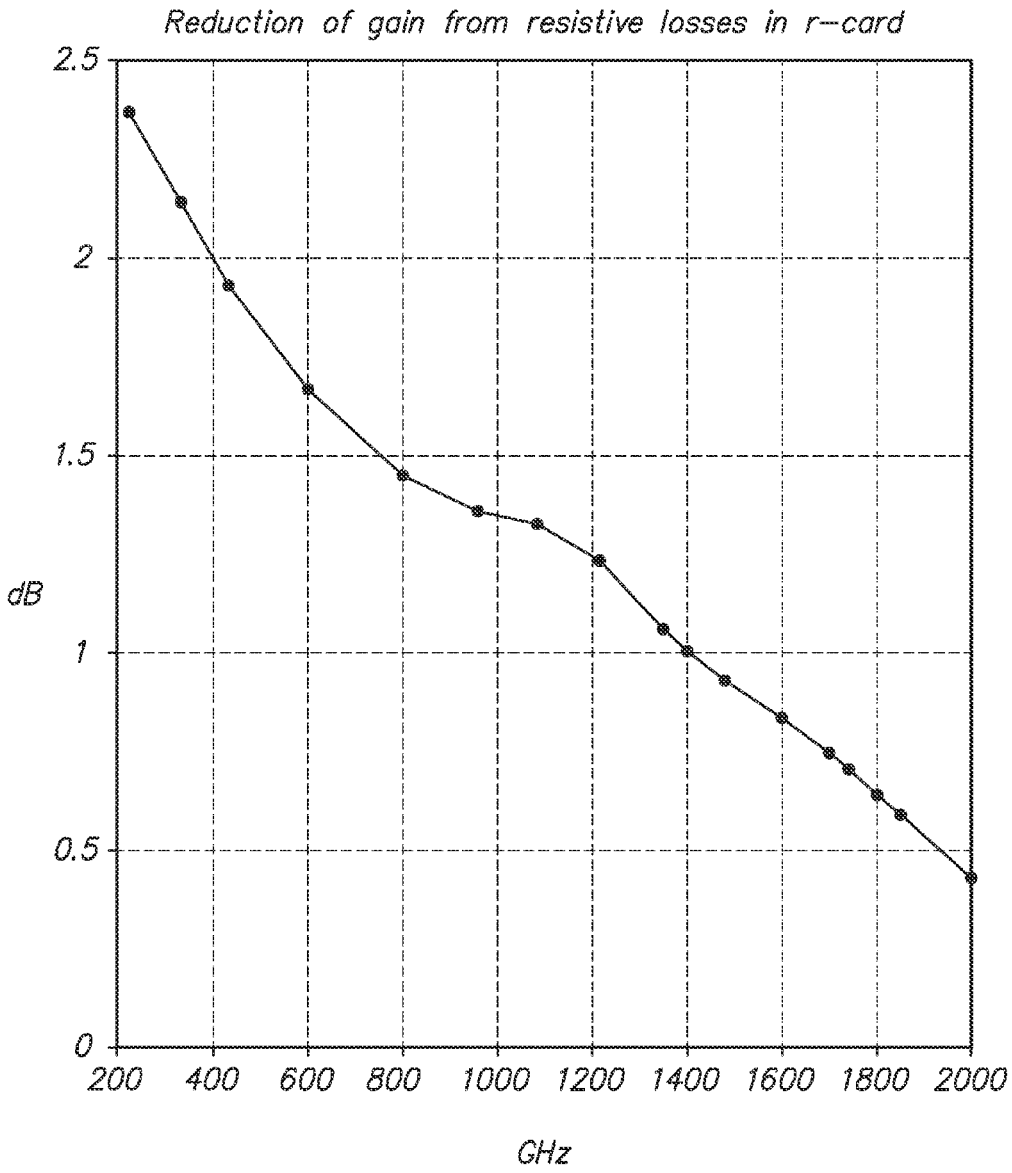
FIG. 12 is a plot indicating the reduction of gain of the Vivaldi antenna of FIG. 7, for various frequencies.

FIG. 12 is a plot showing the reduction of gain of the antenna 70 of FIG. 7, due to resistive losses in the resistive film extension 79, over a range of frequencies. Evident is that fact that as the frequency decreases, the reduction in the gain also increases by approximately 2 dB from the upper frequency (2 GHz) to the lower frequency (200 MHz). This phenomenon is due to more of the RF energy reaching the resistive film extension 79 at longer wavelengths, where it is absorbed. Computer analyses have shown that the resistive film absorbs only a very small part of the RF energy, and that most of the RF energy fed into the antenna is radiated.

Figure 13:
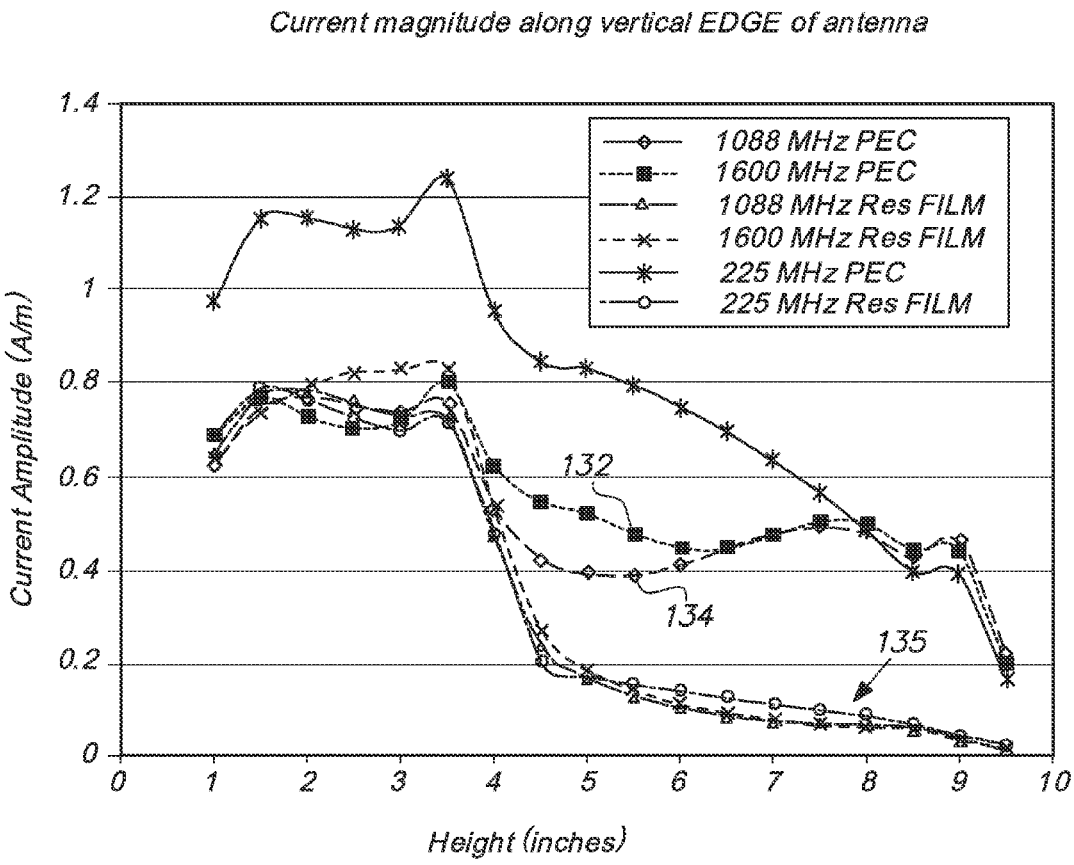
FIG. 13 is a plot of antenna surface current amplitudes as a function of height along an edge for a perfect electrical conductor (PEC) extension antenna and a Resistive Film extension antenna, at different frequencies.

FIG. 13 is a plot showing the current magnitude profile as a function of height along the edges of various antenna types (PEC extension vs. Resistive Film extension) for three different frequencies. The characteristic peaks and valleys evident in a standing wave pattern are very noticeable for the 1600 MHz PEC 132 and the 1088 MHz PEC 134 curves. Conversely, the peaks and valleys are virtually absent from the bundle of Res FILM curves indicated by 135.

Figure 14:
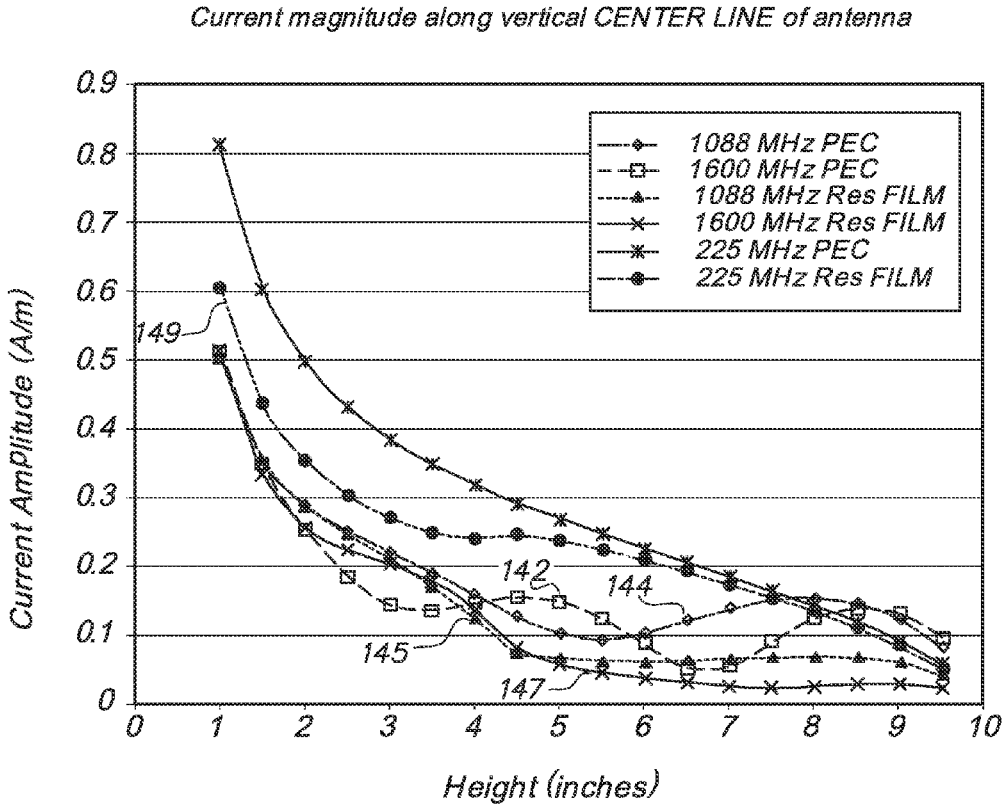
FIG. 14 is a plot of antenna surface current amplitudes as a function of height along a centerline for a PEC extension antenna and a Resistive Film extension antenna, at different frequencies.

FIG. 14 is a plot showing the current magnitude profile as a function of height along the center of various antenna types (PEC extension vs. Resistive Film extension) for three different frequencies. The characteristic peaks and valleys evident in a standing wave pattern are very noticeable for the 1600 MHz PEC 142 and the 1088 MHz PEC 144 curves. Conversely, the peaks and valleys are virtually absent from the Res FILM curves 145, 147, 149. These two plots (FIGS. 13 and 14) illustrate the beneficial effect of suppressing standing waves by use of an extension fabricated from resistive film. In view of the above results, another modification of the antenna 70 of FIG. 7 was contemplated, one where the boundaries are curved or tapered.

Figure 15:
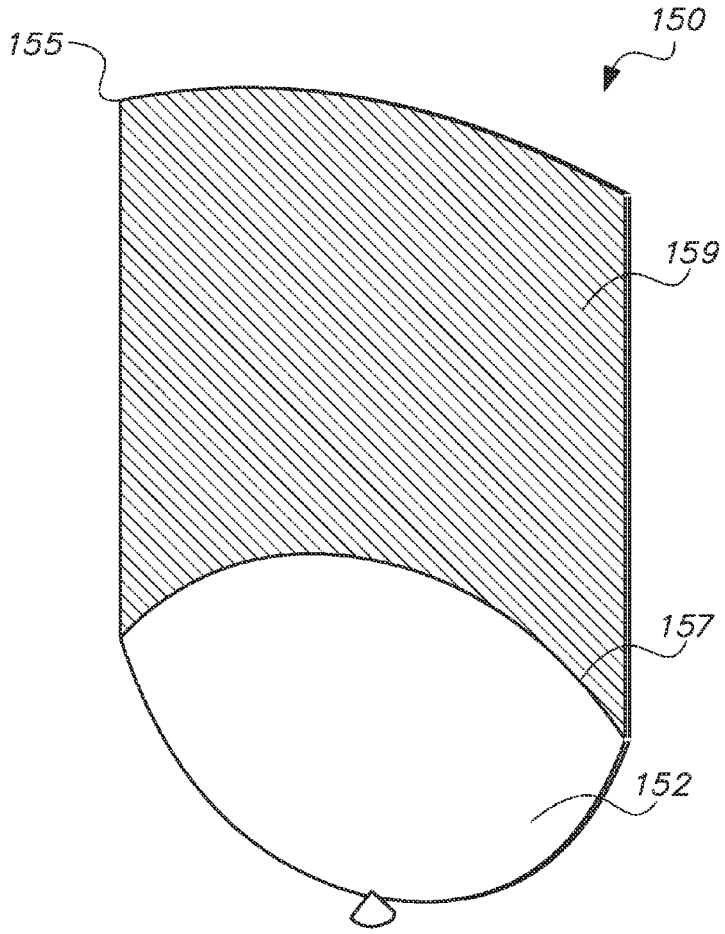
FIG. 15 is an illustration of another double Vivaldi antenna element with a curved boundary between the lower Vivaldi metal section and the upper resistive film extension.

FIG. 15 is an illustration of an exemplary double Vivaldi antenna 150 with a resistive film extension 159 joined at a boundary 157 to the lower metal section 152. Any form of joining may be used, as long as there is electrical contact along the entire boundary between the antenna's lower metal section 152 and the resistive film extension 159. Some non-limiting examples of joining may be screws, epoxy, bolts, friction, and so forth. It is noted that the boundary 157 is curved as well as the end 155 of the resistive film extension 159. The curvature of the boundary 157 is tailored to have a larger mid-section than an end section, and can be considered to be concave in many respects. The curvature of the boundary 157 was found to help reduce the standing wave patterns in the antenna by dispersing the waves reflected at the boundary 157 between the metal 152 and resistive film extension 159. This is partly because the angle between the outer edge of the resistive film extension 159 and the boundary 157 has a value of about thirty degrees.

The principle behind this approach is that at higher frequencies, most of the RF energy travels along the outer edge of the metal section 152. With the curved boundary 157, part of the RF energy can flow along the outer edge of the resistive film extension 159, while another part can flow along the curved boundary 157 before being absorbed. The curvature provides a smoother transition to the current paths, thus minimizing reflections. This design was found to improve the antenna patterns by reducing the on-horizon broadside null at higher frequencies.

Figure 16:
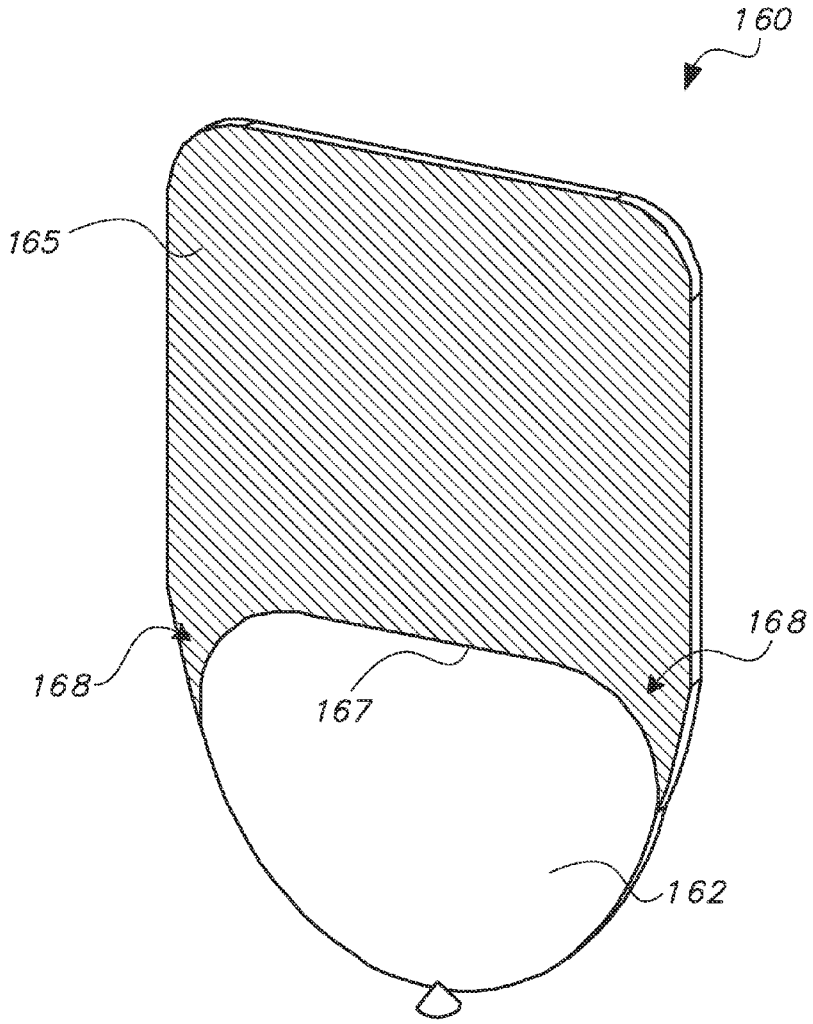
FIG. 16 is an illustration of another double Vivaldi element with the boundary between the lower Vivaldi metal section and the upper resistive film extension having circularly curved corners and a flat center section.

FIG. 16 is an illustration of another exemplary double Vivaldi antenna design 160, which is similar to the exemplary antenna 150 of FIG. 15, except that another shape is used for the boundary 167 between the metal 162 and resistive film section 165. In this exemplary embodiment 160, the boundary 167 has circular curvature at its ends 168 and is flat in the middle. This shape for the boundary 167 help reduce the standing wave patterns in the exemplary antenna 160 because the waves passing by the ends 168 of the boundary 167 experience a gradual transition from metal to resistive film.

A further challenge in the development of the exemplary antennas was the development of a housing which would not disrupt or degrade the antenna patterns. An outer housing made from FR-4 material (or any glass reinforced epoxy material) was selected due to its high strength, allowing it to withstand air speeds up to Mach 2. However, FR-4 has a high dielectric constant of about 4.5. Enclosing the upper portion of the exemplar antennas in FR-4 material does not degrade the performance of the antenna, but enclosing the Vivaldi feed section of the antenna with the FR-4 material directly contacting it, seriously degraded the antenna's gain patterns and caused nulls to reappear at certain frequencies and angles, including a null at high frequencies at the horizon, broadside to the blade.

This difficulty was overcome by enclosing the exemplary antenna with an FR-4 housing having a reduced thickness of 0.1 inch around the Vivaldi feed section, then filling the void between the Vivaldi feed section of the antenna and the FR-4 housing with a lower dielectric constant material, such as fluoropolymer like polytetrafluoroethylene (PTFE) sold under the trademark TEFLON® by E.I. du Pont de Nemours and Company of Wilmington, Del., or PTFE material such as DUROID® 5870, supplied by Rogers Corporation of Rogers, Conn. TEFLON® material has a dielectric constant of about 2.08, while DUROID® 5870, has a dielectric constant of about 2.33. Thus, using a thinner but structurally superior material such as FR-4 for the outer shell, and lining the inner section with a less robust filler material, but having a lower dielectric constant, was found to be an economical solution. Of course, while FR-4 was used as the housing material, other materials and/or thicknesses that are suitable may be used. Similarly, while TEFLON® or DUROID® material was used as filler, other suitable materials may be used. Accordingly, various modifications and changes to the composition and type of materials may be utilized without departing from the spirit and scope of this disclosure.

Figure 17:
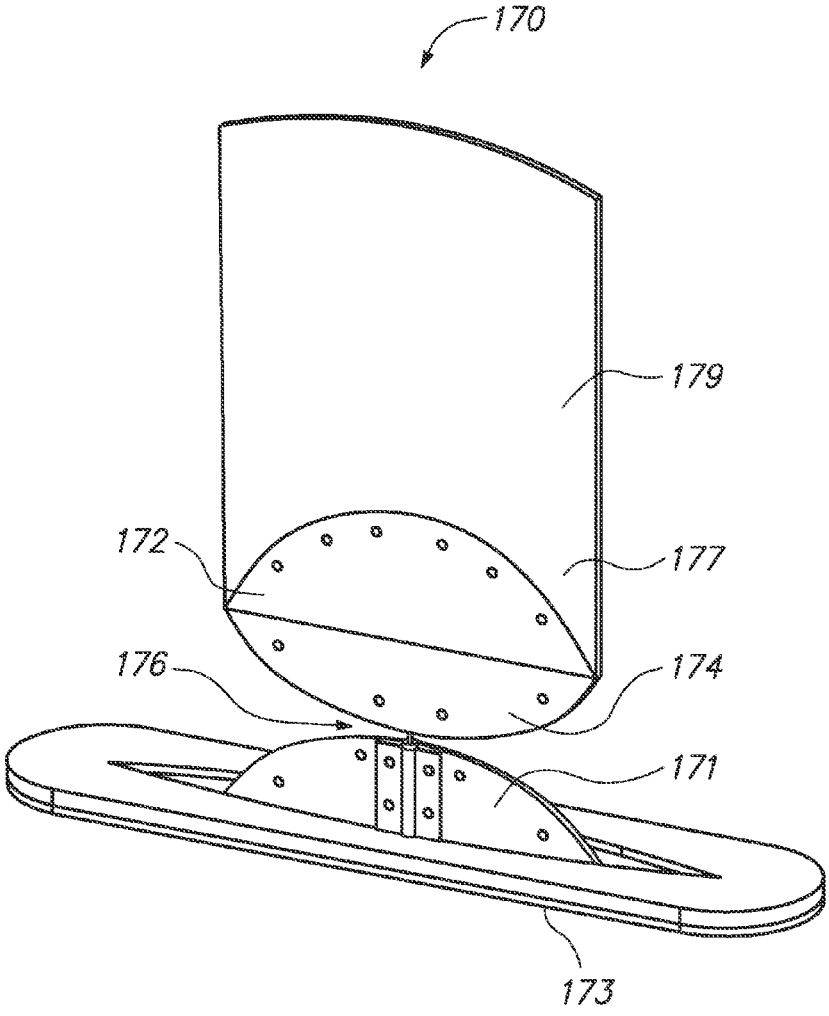
FIG. 17 is an illustration of the Vivaldi feed section of FIG. 15 replaced by a two component section.

Another modification, in the context of enhancing structural robustness, was the addition of a "bottom" section to the Vivaldi structure 171 with pass through feed 176 and base 173, as shown in FIG. 17. The base 173 operates to secure the exemplary antenna 170 to a platform (not shown). The bottom Vivaldi structure 171 provides a more robust structure for attachment to the base 173 and was found to further benefit the high frequency patterns in that the entire Vivaldi structure is raised higher above the ground plane, resulting in removal of broadside nulls at the higher frequencies. Taking into account ground image currents, only the lower half 174 of the upper Vivaldi structure 172 was replicated in the bottom Vivaldi structure 171.

As in FIG. 15's embodiment, the top of the resistive film extension 179 is tapered with a "rounder" curved edge to help adjust the amplitudes of the waves reflected from it to optimize the cancellation of the waves reflected from the metal-to-resistive film boundary 177.

Figure 18:
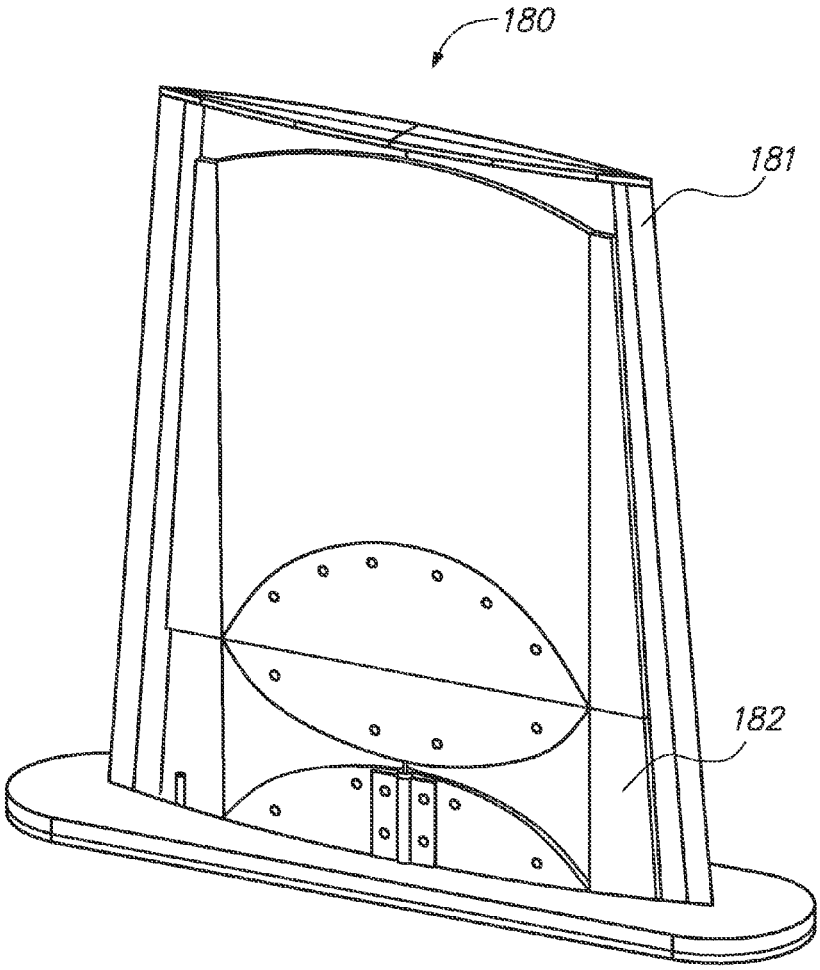
FIG. 18 is an illustration of a cutaway view the Vivaldi antenna of FIG. 17 with an external housing.

FIG. 18 is a cut-away perspective illustration 180 of the exemplary double Vivaldi antenna 170 of FIG. 17 with a housing 181, and illustrates a filler material 182 interior to the housing 181. It is noted that the filler material can only be located around the Vivaldi section, whereas the rest of the housing can be made entirely of FR-4.

Figure 19:
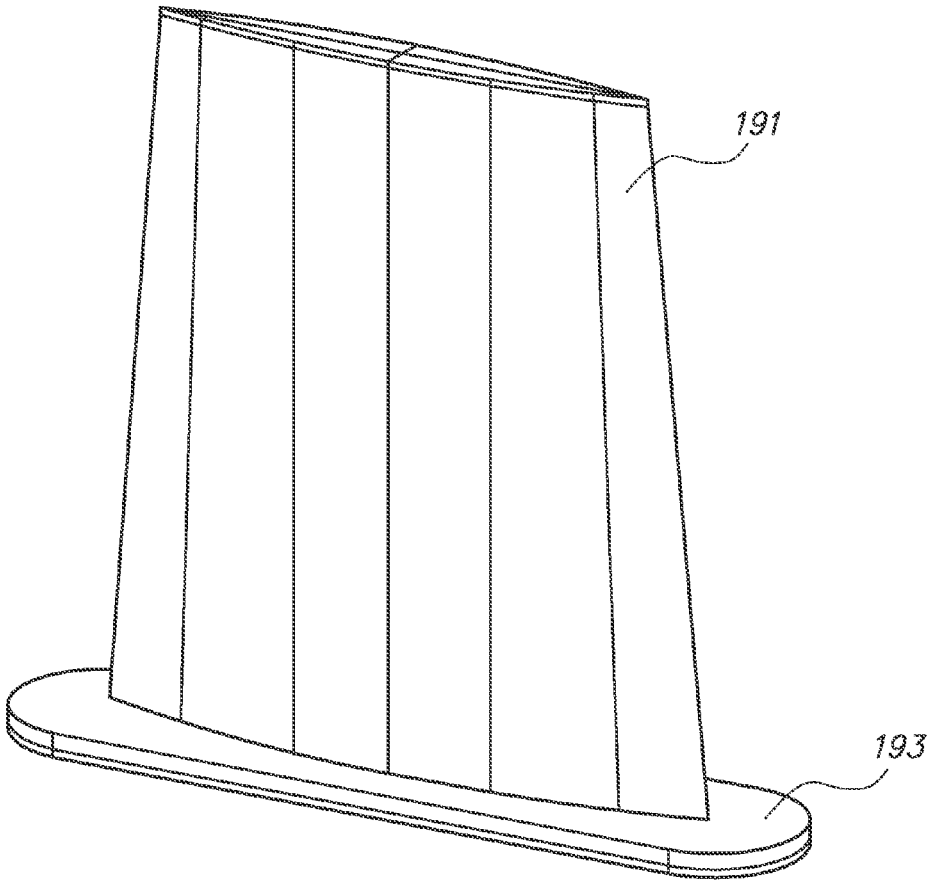
FIG. 19 is an illustration of the housing.

FIG. 19 is an exterior perspective illustration of the housing 191 and base 193, revealing its final shape as a blade antenna. As mentioned above, the aerodynamic shape of the housing/antenna enables this exemplary design to be well suited for aircraft and other high speed platforms.

Figure 20:
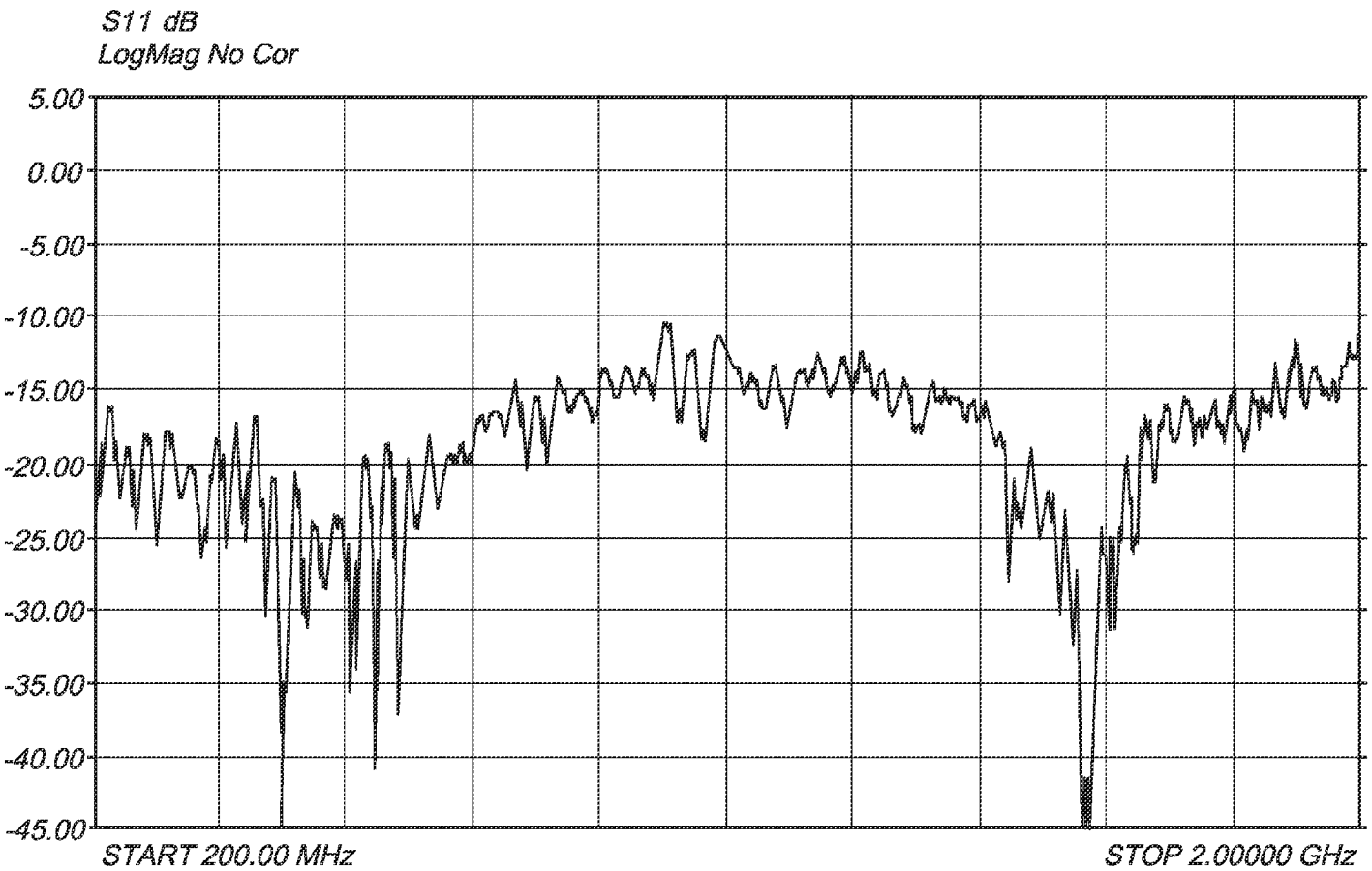
FIG. 20 is a plot of the $S_{11}$ response of the Vivaldi antenna of FIG. 17.

FIG. 20 is a dB magnitude plot of $S_{11}$ data from an experimentally tested prototype antenna of the configuration shown in FIG. 17. Each graduation on the horizontal axis represents a 180 MHz increment. Over the 200 MHz-2.00 GHz range, the $S_{11}$ (input reflection coefficient) value never exceeds −10 dB, indicating that the antenna is not reflecting significant energy back into the feed port, and is efficiently radiating the RF energy fed into it.

Figure 21:
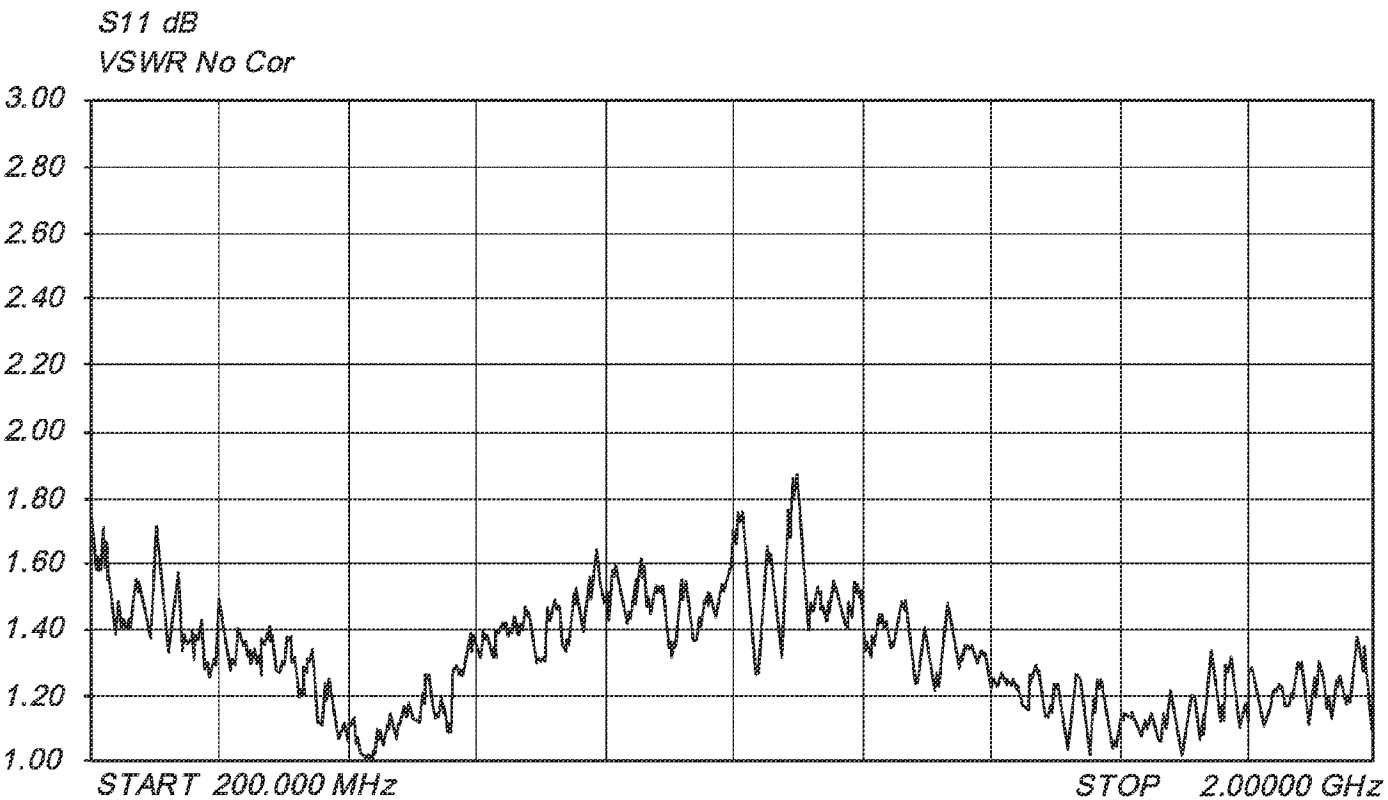
FIG. 21 is a plot of the VSWR response of the Vivaldi antenna of FIG. 17.

FIG. 21 is VSWR $S_{11}$ data from an experimentally tested prototype antenna of the configuration shown in FIG. 17. Each graduation on the horizontal axis represents a 180 MHz increment. Over the 200 MHz-2.00 GHz range, the antenna's VSWR is significantly below 2 indicating very good VSWR performance.

Figure 22:
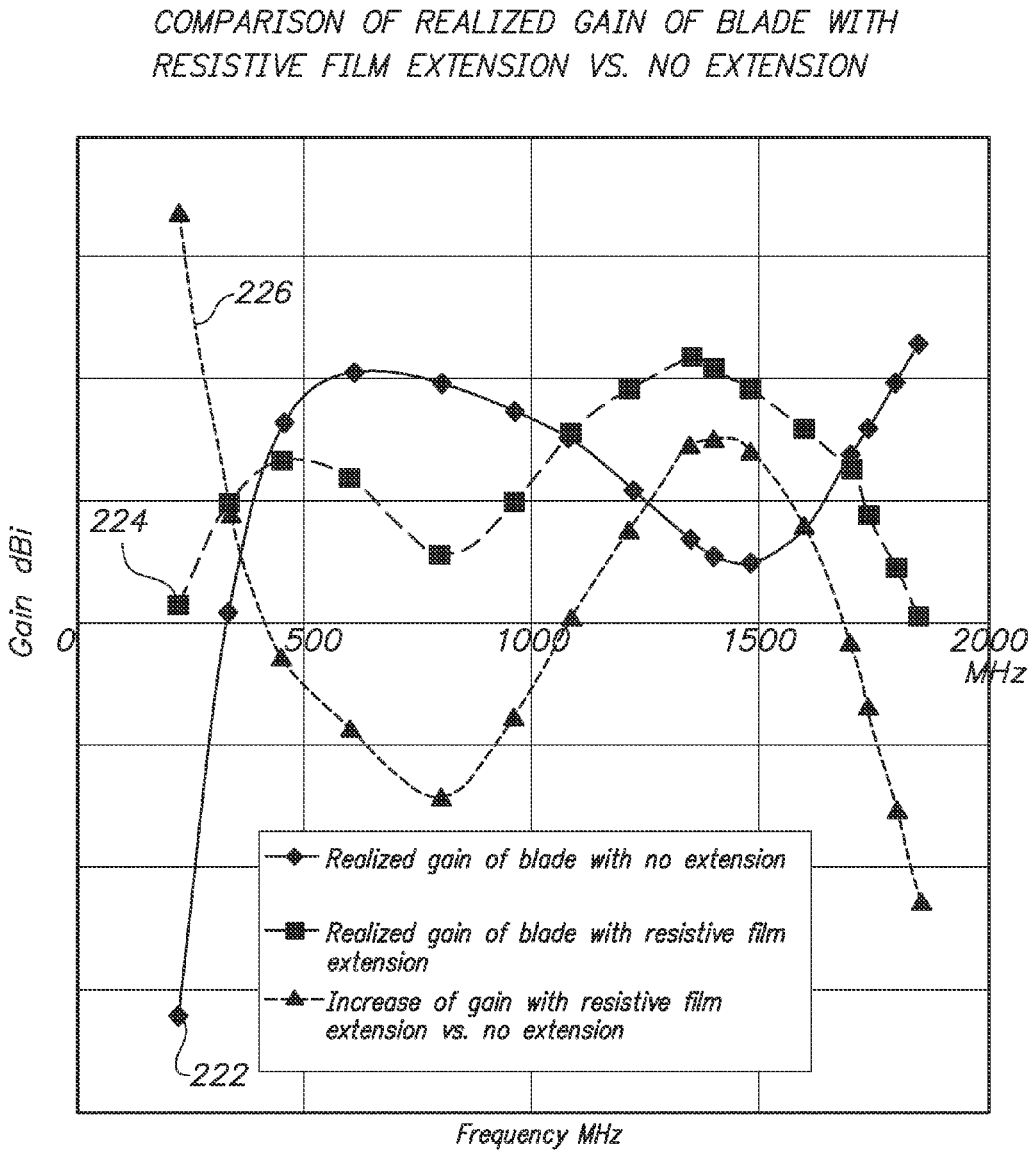
FIG. 22 is a plot comparing the realized gain of the double Vivaldi antenna of FIG. 16 with the realized gain of the antenna with the same antenna with the resistive film extension removed.

FIG. 22 is a plot comparing the realized gain at the horizon of the double Vivaldi antenna 160 with the resistive film extension 165 of FIG. 16 to that of the same antenna with the resistive film extension 165 removed. The data shows that at the low end of the frequency range, at 225 MHz, the realized gain of the antenna without the extension (line 222) drops to −6.4 dBi, and that adding the extension (line 224) corrects this problem and enables the antenna to attain the objective of a gain at the horizon greater than or equal to 0 dBi over the 225-1850 MHz frequency range. Line 226 illustrates the overall gain improvement, particularly at the low frequency end. It is understood that realized gain takes into account reflections at the antenna input port due to impedance mismatch. Although this analysis was carried out only for antenna 160 of FIG. 16, it is implicit that very similar results would also apply to other designs, such as antenna 70 of FIG. 7 and antenna 150 of FIG. 15.

Testing of the exemplary prototype antenna of FIG. 17 revealed that it achieved broad patterns in azimuth and elevation, and a broad frequency bandwidth on the order of 8:1 or greater. It also achieved a minimum gain at the horizon of 0 dBi, while maintaining a VSWR of less than 2:1 over the entire 225 MHz to 1.85 GHz frequency range. One exemplary antenna that was fabricated had an overall height of 9.8" and a width of 5.6", with a housing height of 10.1", a width of 9.3" and a thickness of 0.9". This represents a very aggressive performance profile for such a compact antenna. Of course, the dimensions of the exemplary antennas may be increased or reduced, however it is not believed that the dimensions can be reduced by more than 10% without affecting the antenna's performance within the frequency range of interest. Additional computer modeling showed that the exemplary prototype antenna of FIG. 17 was able to function even better without using an aerodynamically formed FR4 external housing, providing higher gain, more uniform patterns and lower VSWR. This indicates that the prototype antenna of FIG. 17, with the original housing replaced with a simpler, low-dielectric-constant housing, could function very well as a general purpose, compact, wideband, omnidirectional antenna.

Based on the above results, a compact broadband antenna capable of operating within 225 MHz to 1.85 GHz while maintaining an omnidirectional pattern has been demonstrated. However, it is well understood that specified frequency range devices such as the antennas described herein can be modified for different frequency ranges by adjustment of the respective antenna dimensions. Accordingly, while the exemplary embodiments described herein are detailed in the context of operating between 225 MHz to 1.85 GHz, different frequency ranges can be achieved by suitable modification as according to the knowledge of one of ordinary skill in the antenna arts.

It is also understood that antennas are reciprocal devices, capable of transmitting radio signals as well as receiving radio signals. Therefore, while the FIGS. of the exemplary embodiments do not illustrate a transmitter or receiver, such devices and systems are implicit for the operation of an antenna. Additionally, while the term "radio" is used to signify a particular type of electromagnetic radiation, it is understood that it is not limited to a specific frequency range, as in the classic context. Due to scalability of the exemplary antenna, the term radio is generically used to describe time-harmonic electromagnetic signals.

Therefore, it will be understood that many additional changes in the details, materials, steps and arrangement of parts, which have been herein described and illustrated to explain the nature of the disclosure, may be made by those skilled in the art within the principal and scope of the disclosure as expressed in the appended claims.

What is claimed is:

1. A broadband, low voltage standing wave ratio, omnidirectional, antenna, comprising:

a ground plane having a feed point;

a first antenna section;

a second antenna section;

said first and second antenna sections extend upward from the feed point in a parabolic fashion of equal radius, each section forming a Vivaldi structure in the respective portion of the antenna section proximately located to the ground plane and subsequently embodying simple curved sections such that each antenna element has an opposed, joined surface above the ground plane feed point and generally perpendicular thereto.

2. The antenna of claim 1, wherein the simple curved section is approximately 30 degrees.

3. The antenna of claim 1, wherein each antenna section has a height less than three inches from the feedpoint to the top of the antenna.

4. The antenna of claim 1, wherein the width of the antenna is approximately four and one-half inches.

5. The antenna of claim 1, further comprising a blade-shaped protective housing about the antenna.

6. The antenna of claim 5, wherein the housing is made of FR-4 material.

7. The antenna of claim 1, wherein a frequency range of the antenna is between 225 MHz and 1.85 GHz.

8. The antenna of claim 5, further comprising a filler material between the antenna and the housing.

9. A method for efficiently radiating/receiving electromagnetic radiation in an omnidirectional pattern, with a low voltage standing wave ratio, comprising:

forming an antenna having a double Vivaldi element, each Vivaldi element having a bottom portion having edges with Vivaldi curves, and a top portion extending above each Vivaldi curve and further incorporating a curved shaped edge;

joining a non-metallic, co-planar upper element resistive sheet from each curve shaped edge to the portion proximately above each Vivaldi curve;

coupling a feed to a feed-side of the Vivaldi element; and at least one of exciting the feed with a radio signal or receiving a radio signal from the feed.

10. The method of claim 9, wherein the curve shaped edge is approximately 30 degrees.

11. The method of claim 9, wherein a top edge of the resistive sheet is curved.

12. The method of claim 9, wherein a resistance of the resistive sheet is approximately 150 ohms/square.

13. A broadband, low voltage standing wave ratio, omnidirectional, planar antenna, comprising:

a ground plane having a feed point;

a first antenna section;

a second antenna section;

said first and second antenna sections extend upward from the feed point in a parabolic fashion of equal radius, each section forming a Vivaldi structure in the respective portion of the antenna section proximately located to the ground plane and subsequently embodying mirror coplanar vertical extensions with simple curved sections such that each antenna element has an opposed, joined surface above the ground plane feed point and generally perpendicular thereto.

14. The antenna of claim 13, further comprising a blade-shaped protective housing about the antenna.

15. The antenna of claim 14, wherein the housing is made of FR-4 material.

16. The antenna of claim 13, wherein a resistance of the resistive sheet is approximately 150 ohms/square.

17. The antenna of claim 14, further comprising a filler material between the antenna and the housing.

18. The antenna of claim 13, wherein said antenna has a height of less than ten inches, a broadside width of less than six inches and an edge thickness of less than one inch.

* * * * *